US009957594B2

(12) United States Patent
Novotny

(10) Patent No.: US 9,957,594 B2
(45) **Date of Patent: *May 1, 2018**

(54) HIGH STRENGTH, HIGH TOUGHNESS STEEL ALLOY

(71) Applicant: CRS HOLDINGS, INC., Wilmington, DE (US)

(72) Inventor: Paul M. Novotny, Mohnton, PA (US)

(73) Assignee: CRS HOLDINGS, INC., Wilmington, DE (US)

( * ) Notice: Subject to any disclaimer, the term of this patent is extended or adjusted under 35 U.S.C. 154(b) by 211 days.

This patent is subject to a terminal disclaimer.

(21) Appl. No.: 14/857,108

(22) Filed: Sep. 17, 2015

(65) Prior Publication Data

US 2016/0002757 A1 Jan. 7, 2016

Related U.S. Application Data

(63) Continuation of application No. 13/457,631, filed on Apr. 27, 2012, now abandoned.

(51) Int. Cl.

| | |
|---|---|
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/52*** | (2006.01) |
| ***C22C 38/00*** | (2006.01) |
| ***C22C 38/04*** | (2006.01) |
| ***C22C 38/34*** | (2006.01) |
| ***C21D 1/18*** | (2006.01) |
| ***C22C 38/02*** | (2006.01) |
| ***C22C 38/58*** | (2006.01) |
| ***C21D 6/00*** | (2006.01) |

(52) U.S. Cl.

CPC ..... *C22C 38/46* (2013.01); *C21D 1/18* (2013.01); *C21D 6/001* (2013.01); *C21D 6/004* (2013.01); *C21D 6/005* (2013.01); *C21D 6/008* (2013.01); *C22C 38/002* (2013.01); *C22C 38/005* (2013.01); *C22C 38/02* (2013.01); *C22C 38/04* (2013.01); *C22C 38/34* (2013.01); *C22C 38/42* (2013.01); *C22C 38/44* (2013.01); *C22C 38/48* (2013.01); *C22C 38/58* (2013.01); *C21D 2211/008* (2013.01)

(58) Field of Classification Search
None
See application file for complete search history.

(56) References Cited

U.S. PATENT DOCUMENTS 3,713,905 A * 1/1973 Philip ..... C22C 38/42 148/319
9,518,313 B2 * 12/2016 Novotny ..... C21D 6/004

FOREIGN PATENT DOCUMENTS

JP 2003-105485 * 4/2003 ..... C22C 38/00

* cited by examiner

*Primary Examiner* — Deborah Yee
(74) *Attorney, Agent, or Firm* — Dann, Dorfman, Herrell and Skillman, P.C.

(57) ABSTRACT

A high strength, high toughness steel alloy is disclosed. The alloy has the following weight percent composition.

| Element | |
|---|---|
| C | 0.30-0.55 |
| Mn | 0.6-1.75 |
| Si | 0.9-2.8 |
| Cr | 0.6-2.5 |
| Ni | 2.70-7.0 |
| Mo + ½ W | 0.25-1.3 |
| Cu | 0.30-1.25 |
| Co | 0.01 max. |
| V + (5/9) × Nb | 0.10-1.0 |
| Ti | 0.01 max. |
| Al | 0.015 max. |
| Ca | 0.005 max. |

The alloy further includes a grain refining element selected from the group consisting of 0.0001-0.01% Mg, 0.001-0.025% Y, and a combination thereof. The balance of the alloy is iron and the usual impurities found in commercial grades of steel alloys produced for similar use and properties. In this regard phosphorus is limited to not more than about 0.01% and sulfur is limited to not more than about 0.001%. Also disclosed is a hardened and tempered article that has very high strength and fracture toughness. The article is formed from the alloy having the weight percent composition set forth above. The alloy article according to this aspect of the invention is further characterized by being tempered at a temperature of about 500° F. to 600° F.

12 Claims, No Drawings

HIGH STRENGTH, HIGH TOUGHNESS STEEL ALLOY

CROSS REFERENCE TO RELATED APPLICATION

This application is a continuation of U.S. application Ser. No. 13/457,631, filed Apr. 27, 2012, now abandoned, the entirety of which is incorporated herein by reference.

BACKGROUND OF THE INVENTION

Field of the Invention

This invention relates to high strength, high toughness steel alloys, and in particular, to such an alloy that provides a unique combination of tensile strength and toughness when hardened and tempered.

Description of the Related Art

Age-hardenable martensitic steels that provide a combination of very high strength and toughness are known. Among the known steels are those described in U.S. Pat. No. 4,076,525 and U.S. Pat. No. 5,087,415. The former is known as AF1410 alloy and the latter is sold under the registered trademark AERMET. The combination of very high strength and toughness provided by those alloys is a result of their compositions which include significant amounts of nickel, cobalt, and molybdenum, elements that are typically among the most expensive alloying elements available. Consequently, those steels are sold at a significant premium compared to other alloys that do not contain such elements.

More recently, a steel alloy has been developed that provides a combination of high strength and toughness comparable to the AERMET and AF1410 alloys, but without the need for cobalt and with significantly lower amounts of nickel and molybdenum than those alloys. One such steel is described in U.S. Patent Application Publication No. 2011/0165011. The steel described in that patent is an air hardening SiCuNiCr steel alloy. The steel described in the '011 application is capable of providing combinations of very high strength and toughness even when tempered at about 500° F. For example, longitudinal specimens of one embodiment described in the '011 application provided a tensile strength of at least 290 ksi in combination with a Charpy V-notch (CVN) impact strength of at least 20 ft-lbs in the hardened and tempered condition. Longitudinal specimens of another embodiment provided a tensile strength of at least 310 ksi in combination with a CVN impact strength of at least about 16 ft-lbs in the hardened and tempered condition.

However, the potential use of such steels in critical aerospace components has driven a need to extend the combination of strength and toughness provided by such alloys to higher levels than previously achieved. Consequently, a need has arisen for an air-hardening SiCuNiCr steel alloy that provides tensile strength in excess of about 295 ksi in combination with an impact toughness in excess of about 15 ft-lbs. This combination of properties should be provided after the alloy has been tempered at about at least 500° F. Since it is known that toughness and tensile strength are inversely related, the solution to this need is not easily achieved.

SUMMARY OF THE INVENTION

The need described above is realized to a large degree by an alloy according to the present invention. In accordance with one aspect of the present invention, there is provided a high strength, high toughness steel alloy that has the following broad and preferred weight percent compositions.

| Element | Broad | Intermediate | Preferred A | Preferred B |
|---|---|---|---|---|
| C | .30-.55 | .35-.50 | .33-.45 | .40-.50 |
| Mn | .6-1.75 | .7-1.5 | .8-1.3 | .8-1.3 |
| Si | .9-2.8 | 1.2-2.7 | 1.0-2.70 | 1.5-2.70 |
| Cr | .6-2.5 | .7-2.0 | 1.5-1.8 | 1.5-1.8 |
| Ni | 2.70-7.0 | 2.75-5.0 | 3.0-4.5 | 4.0-5.0 |
| Mo + ½ W | .25-1.3 | .4-1.1 | .25-.90 | .25-.90 |
| Cu | .30-1.25 | .35-1.2 | .35-1.25 | .35-1.2 |
| Co | .01 max. | .01 max. | .01 max. | .01 max. |
| V + (5/9) × Nb | .1-1.0 | .25-1.0 | .10-.40 | .10-.40 |
| Ti | .01 max. | .01 max. | .01 max. | .01 max. |
| Al | .015 max. | .01 max. | .015 max. | .015 max. |
| Y | .001-.025 | .002-.020 | .002-.025 | .002-.020 |
| Mg | .0001-.01 | .0001-.006 | .0001-.006 | .0001-.008 |
| Ca | .005 max. | .002 max. | .001 max. | .001 max. |
| Fe | Balance | Balance | Balance | Balance |

Included in the balance are the usual impurities found in commercial grades of steel alloys produced for similar use and properties. Among said impurities phosphorus is preferably restricted to not more than about 0.01% and sulfur is preferably restricted to not more than about 0.001%. Within the foregoing weight percent ranges, silicon, copper, and vanadium are balanced such that $$2 \leq (\%\ Si + \%\ Cu)/(\%\ V + (5/9) \times \%\ Nb) \leq 34.$$

The foregoing tabulation is provided as a convenient summary and is not intended to restrict the lower and upper values of the ranges of the individual elements for use in combination with each other, or to restrict the ranges of the elements for use solely in combination with each other. Thus, one or more of the ranges can be used with one or more of the other ranges for the remaining elements. In addition, a minimum or maximum for an element of a broad or preferred composition can be used with the minimum or maximum for the same element in another preferred or intermediate composition. Moreover, the alloy according to the present invention may comprise, consist essentially of, or consist of the constituent elements described above and throughout this application. Here and throughout this specification the term "percent" or the symbol "%" means percent by weight or mass percent, unless otherwise specified.

In accordance with another aspect of the present invention, there is provided a hardened and tempered steel alloy article that has very high strength and fracture toughness. The article is formed from an alloy having any of the broad, intermediate, or preferred weight percent compositions set forth above. The alloy article according to this aspect of the invention is further characterized by being tempered at a temperature of about 500° F. to 600° F.

DETAILED DESCRIPTION

The alloy according to the present invention contains at least about 0.30% and preferably at least about 0.35% carbon. Carbon contributes to the high strength and hardness capability provided by the alloy. When higher strength and hardness are desired, the alloy preferably contains at least about 0.33% carbon (e.g., Preferred A) or at least about 0.40% carbon (e.g., Preferred B). Carbon is also beneficial to the temper resistance of this alloy. Too much carbon adversely affects the toughness provided by the alloy. Therefore, carbon is restricted to not more than about 0.55% and better yet to not more than about 0.50%. Preferably, the alloy contains not more than about 0.45% carbon for good toughness at higher strength and hardness levels. The inventor has found that when the alloy contains as little as 0.33% carbon, the upper limit for carbon can be restricted to not more than about 0.45% and the alloy can be balanced with respect to its constituents (e.g., Preferred A) to provide a tensile strength of at least about 295 ksi.

At least about 0.6%, better yet at least about 0.7%, and preferably at least about 0.8% manganese is present in this alloy primarily to deoxidize the alloy. It has been found that manganese also benefits the high strength provided by the alloy. If too much manganese is present, then an undesirable amount of retained austenite may result during hardening and quenching such that the high strength provided by the alloy is adversely affected. Therefore, the alloy may contain up to about 1.75% or 1.5% manganese. Otherwise, the alloy contains not more than about 1.3% manganese.

Silicon benefits the hardenability and temper resistance of this alloy. Therefore, the alloy contains at least about 0.9% silicon and preferably, at least about 1.2% silicon. At least about 1.0% and preferably at least about 1.5% silicon is present in the alloy when higher hardness and strength are needed. Too much silicon adversely affects the hardness, strength, and ductility of the alloy. In order to avoid such adverse effects silicon is restricted to not more than about 2.8% and preferably to not more than about 2.7% in this alloy.

The alloy according to this invention contains at least about 0.6% chromium because chromium contributes to the good hardenability, high strength, and temper resistance provided by the alloy. Preferably, the alloy contains at least about 0.7% and better yet at least about 1.5% chromium. More than about 2.5% chromium in the alloy adversely affects the impact toughness and ductility provided by the alloy. In the high strength embodiments of this alloy chromium is restricted to not more than about 1.8%. Otherwise, chromium is preferably restricted to not more than about 2.0% in this alloy.

Nickel is beneficial to the good toughness provided by the alloy according to this invention. Therefore, the alloy contains at least about 2.7% nickel and preferably at least about 2.75% nickel. A preferred embodiment of the alloy (e.g., Preferred A) contains at least about 3.0% nickel. When the alloy is balanced to provide higher strength, it preferably contains at least about 4.0%. The benefit provided by larger amounts of nickel adversely affects the cost of the alloy without providing a significant advantage. In order to limit the upside cost of the alloy, the amount of nickel is restricted to not more than about 7.0%. Thus, for the highest strength embodiment of the alloy (e.g., Preferred B), up to about 5.0% nickel can be present. In lower strength embodiments (e.g., Preferred A) the alloy contains not more than about 4.5% nickel.

Molybdenum is a carbide former that is beneficial to the temper resistance provided by this alloy. The presence of molybdenum boosts the tempering temperature of the alloy such that a secondary hardening effect is achieved at about 500° F. Molybdenum also contributes to the strength and fracture toughness provided by the alloy. The benefits provided by molybdenum are realized when the alloy contains at least about 0.25% molybdenum, better yet, at least about 0.4%, and preferably at least about 0.5% molybdenum. For higher strength, the alloy contains at least about 0.7% molybdenum. Like nickel, molybdenum does not provide an increasing advantage in properties relative to the significant cost increase of adding larger amounts of molybdenum. For that reason, the alloy contains up to about 1.3% molybdenum, better yet not more than about 1.1% molybdenum, preferably not more than about 0.90% molybdenum in the higher strength forms of the alloy (Preferred A and Preferred B). Tungsten may be substituted for some or all of the molybdenum in this alloy. When present, tungsten is substituted for molybdenum on a 2:1 basis.

This alloy preferably contains at least about 0.30% copper which contributes to the hardenability and impact toughness of the alloy. When higher strength is desired, the alloy contains at least about 0.35% copper. Too much copper can result in precipitation of an undesirable amount of free copper in the alloy matrix and adversely affect the fracture toughness of the alloy. Therefore, not more than about 1.25% and preferably not more than about 1.2% copper is present in this alloy.

Vanadium contributes to the high strength and good hardenability provided by this alloy. Vanadium is also a carbide former and promotes the formation of carbides that help provide grain refinement in the alloy and that benefit the temper resistance and secondary hardening of the alloy. For those reasons, the alloy preferably contains at least about 0.10% and preferably at least about 0.25% vanadium. Too much vanadium adversely affects the strength of the alloy because of the formation of larger amounts of carbides in the alloy which depletes carbon from the alloy matrix material. Accordingly, the alloy may contain up to about 1.0% vanadium, but preferably contains not more than about 0.40% vanadium. Niobium can be substituted for some or all of the vanadium in this alloy because like vanadium, niobium combines with carbon to form $M_4C_3$ carbides that benefit the temper resistance and hardenability of the alloy. When present, niobium is substituted for vanadium on 1.8:1 basis.

This alloy may also contain a small amount of calcium up to about 0.005% retained from additions during melting of the alloy to help remove sulfur and thereby benefit the fracture toughness provided by the alloy. Preferably, the alloy contains not more than about 0.002% or 0.001% calcium.

Silicon, copper, vanadium, and when present, niobium are preferably balanced within their above-described weight percent ranges to benefit the novel combination of strength and toughness that characterize this alloy. More specifically, the ratio (% Si+% Cu)/(% V+(5/9)×% Nb) is about 2 to 34. The ratio is preferably about 6-12 for strength levels below about 290 ksi. For strength levels of 290 ksi and above, the alloy is balanced such that the ratio is about 14.5 up to about 34. It is believed that when the amounts of silicon, copper, and vanadium present in the alloy are balanced in accordance with the ratio, the grain boundaries of the alloy are strengthened by preventing brittle phases and tramp elements from forming on the grain boundaries.

The alloy according to this invention contains a small amount of magnesium, yttrium, or a combination thereof. The magnesium and/or yttrium is added during primary melting to deoxidize the steel alloy. Magnesium and yttrium also benefit the strength and toughness of the new steel by aiding in grain refinement of the alloy during processing. Magnesium is added in sufficient quantities to result in a retained amount of about 0.0001 to 0.01%, preferably about 0.0001 to 0.006%. Yttrium is added in an amount sufficient to yield a retained amount of about 0.001 to 0.025%, preferably about 0.002-0.020%.

The balance of the alloy is essentially iron and the usual impurities found in commercial grades of similar alloys and steels. In this regard, the alloy preferably contains not more than about 0.01%, better yet, not more than about 0.005% phosphorus and not more than about 0.001%, better yet not more than about 0.0005% sulfur. The alloy preferably contains not more than about 0.01% cobalt. Titanium may be present at a residual level of up to about 0.01% from deoxidation additions during melting and is preferably restricted to not more than about 0.005%. Up to about 0.015% aluminum may also be present in the alloy from deoxidation additions during melting.

The alloys according to preferred compositions A and B are balanced to provide very high strength and toughness in the hardened and tempered condition. In this regard, the Preferred A composition is balanced to provide a tensile strength of at least about 295 ksi in combination with good toughness as indicated by a Charpy V-notch impact strength of at least about 16 ft-lbs and a $K_{Ic}$ fracture toughness of at least about 70 ksi√in. In addition, the Preferred B composition is balanced to provide a tensile strength of at least about 310 ksi in combination with a $K_{Ic}$ fracture toughness of at least about 50 ksi√in for applications that require higher strength and good toughness.

No special melting techniques are needed to make the alloy according to this invention. Primary melting of the alloy is preferably accomplished with vacuum induction melting (VIM). When desired, as for critical applications, the alloy can be refined using vacuum arc remelting (VAR). Primary melting may also be performed by arc melting in air (ARC) if desired. After ARC melting, the alloy may be refined by electroslag remelting (ESR) or VAR.

The alloy of this invention is preferably hot worked from a temperature of up to about 2100° F., preferably at about 1800° F., to form various intermediate product forms such as billets and bars. The alloy is preferably heat treated by austenitizing at about 1585° F. to about 1735° F. for about 1-2 hours. The alloy is then air cooled or oil quenched from the austenitizing temperature. When desired, the alloy can be vacuum heat treated and gas quenched. The alloy is preferably deep chilled to either −100° F. or −320° F. for about 1-8 hours and then warmed in air. The alloy is preferably tempered at about 500° F. for about 2-3 hours and then air cooled. The alloy may be tempered at up to 600° F. when an optimum combination of strength and toughness is not required.

The alloy of the present invention is useful in a wide range of applications. The very high strength and good fracture toughness of the alloy makes it useful for machine tool components and also in structural components for aircraft, including landing gear. The alloy of this invention is also useful for automotive components including, but not limited to, structural members, drive shafts, springs, and crankshafts. It is believed that the alloy also has utility in armor plate, sheet, and bars.

WORKING EXAMPLES

Example 1

In order to demonstrate the novel combination of strength and toughness provided by the alloy according to this invention, six 35-lb. heats having the weight percent compositions set forth in Table 1 below were vacuum induction melted and cast into 4-inch square ingots. Prior to casting, the heats were desulfurized with calcium by means of a 0.025 weight percent addition of nickel-calcium.

TABLE 1

| | Heat 1 | Heat 2 | Heat 3 | Heat 4 | Heat A | Heat B |
|---|---|---|---|---|---|---|
| C | 0.35 | 0.36 | 0.37 | 0.36 | 0.36 | 0.36 |
| Mn | 1.17 | 1.18 | 1.18 | 1.18 | 1.18 | 1.19 |
| Si | 2.04 | 2.04 | 2.04 | 2.08 | 2.03 | 2.01 |
| P | <0.005 | <0.005 | <0.005 | <0.005 | <0.005 | <0.005 |
| S | <0.0005 | <0.0005 | <0.0005 | <0.0005 | <0.0005 | <0.0005 |
| Cr | 1.74 | 1.75 | 1.75 | 1.74 | 1.75 | 1.75 |
| Ni | 3.22 | 3.19 | 3.19 | 3.21 | 3.23 | 3.24 |
| Mo | 0.77 | 0.78 | 0.78 | 0.78 | 0.78 | 0.78 |
| Cu | 0.79 | 0.79 | 0.77 | 0.79 | 0.79 | 0.79 |
| V | 0.19 | 0.19 | 0.19 | 0.19 | 0.19 | 0.19 |
| Mg | 0.0001 | 0.0006 | 0.0020 | 0.0060 | — | 0.0100 |
| Ca | 0.0012 | 0.0014 | 0.0012 | 0.0009 | 0.0016 | 0.0007 |

The balance of each heat was iron and usual impurities. Heats 1 to 4 are embodiments of the alloy according to the present invention. Heats A and B are comparative heats. Heats 1 to 4 differ from Heats A and B with respect to the retained amounts magnesium.

The 4-inch square ingots of each of Heats 1-4, A, and B were homogenized at 2300° F. for 6 hours and then hot forged from a starting temperature of 1800° F. to 2¼-inch square billet. A 12-inch long piece was cut from the X-end of each billet and then hot forged from 1800° F. to 1½-inch square bar. The 1½-inch bars were cut into three equal-length pieces. Each of the three pieces was then forged from 1800° F. to ⅝-inch square bar. The ⅝-inch bars were cooled in air to room temperature. Thereafter the bars were annealed at 1250° F. for 8 hours and then air cooled to room temperature.

Duplicate, standard longitudinal test samples for tensile, toughness, and fracture toughness testing were cut from the annealed ⅝-inch bars and machined to finish size. A first set of the samples were heated in vacuum at 1685° F. for 1.5 hours and then quenched with a positive pressure of inert gas. (Heat treatment A.) A second set of the samples were heated in vacuum at 1735° F. for 2 hours and then quenched with a positive pressure of the inert gas. (Heat treatment B.) After quenching, the samples were chilled at −100° F. for 8 hours and then warmed in air to room temperature. Following the cold treatment, the samples were tempered by heating at 500° F. for 2 hours and then cooled in air to room temperature.

Set forth in Tables 2A and 2B are the results of room temperature mechanical testing of the duplicate samples from each heat including the 0.2% offset yield strength (Y.S.) and the ultimate tensile strength (U.T.S.) in ksi, the percent elongation (% El.), the percent reduction in area (% R.A.), the Charpy V-notch impact energy (CVN) in foot-pounds (ft.-lbs.), the rising step load fracture toughness ($K_{Ic}$) in ksi√in, and the Rockwell C-scale hardness (HRC). The tested samples were also metallographically examined for grain size and the ASTM grain size number (Grain Size) for each heat is also shown in Table 2. Table 2A contains the results for the samples given Heat treatment A and Table 2B contains the results for the samples given Heat treatment B.

TABLE 2A

| Heat ID | Sample | Y.S. | U.T.S. | % El. | % R.A. | CVN | $K_{Ic}$ | HRC | Grain Size |
|---|---|---|---|---|---|---|---|---|---|
| Ht. 1 | 1 | 239.8 | 297.5 | 11.1 | 44.0 | 22.6 | 78.9 | | |
| | 2 | 239.7 | 296.8 | 11.4 | 46.0 | 23.2 | 79.8 | | |
| | Avg. | 239.8 | 297.1 | 11.3 | 45.0 | 22.9 | 79.4 | 54.1 | 7.5 |
| Ht. 2 | 1 | 240.0 | 298.7 | 10.8 | 46.4 | 21.8 | 72.3 | | |
| | 2 | 242.8 | 300.1 | 11.5 | 45.2 | 20.0 | 73.4 | | |
| | Avg. | 241.4 | 299.4 | 11.2 | 45.8 | 20.9 | 72.9 | 54.5 | 9 |
| Ht. 3 | 1 | 241.8 | 299.7 | 10.8 | 44.4 | 22.2 | 65.9 | | |
| | 2 | 243.6 | 301.1 | 10.5 | 45.0 | 21.8 | 72.2 | | |
| | Avg. | 242.7 | 300.4 | 10.7 | 44.7 | 22.0 | 69.1 | 54.9 | 8 |
| Ht. 4 | 1 | 242.1 | 296.7 | 10.3 | 45.1 | 21.4 | 67.8 | | |
| | 2 | 243.0 | 302.0 | 9.9 | 43.9 | 21.0 | 70.1 | | |
| | Avg. | 242.5 | 299.3 | 10.1 | 44.5 | 21.2 | 69.0 | 55.0 | 8 |
| Ht. A | 1 | 243.5 | 301.4 | 10.3 | 44.7 | 14.0 | 70.8 | | |
| | 2 | 244.6 | 301.5 | 10.2 | 40.6 | 15.5 | 70.2 | | |
| | Avg. | 244.0 | 301.4 | 10.3 | 42.6 | 14.8 | 70.5 | 55.7 | 7 |
| Ht. B | 1 | 244.6 | 302.6 | 7.9 | 35.4 | 17.0 | 50.2 | | |
| | 2 | 243.3 | 302.0 | 10.4 | 44.4 | 17.1 | 50.0 | | |
| | Avg. | 244.0 | 302.3 | 9.2 | 39.9 | 17.1 | 50.1 | 54.3 | 8.5 |

TABLE 2B

| Heat ID | Sample | Y.S. | U.T.S. | % El. | % R.A. | CVN | $K_{Ic}$ | HRC | Grain Size |
|---|---|---|---|---|---|---|---|---|---|
| Ht. 1 | 1 | 241.0 | 299.5 | 10.7 | 45.7 | 21.8 | 75.4 | | |
| | 2 | 241.3 | 299.8 | 10.5 | 44.6 | 21.7 | 75.6 | | |
| | Avg. | 241.2 | 299.6 | 10.6 | 45.1 | 21.8 | 75.5 | 55.0 | 8 |
| Ht. 2 | 1 | 243.6 | 303.1 | 10.9 | 46.3 | 21.1 | 78.8 | | |
| | 2 | 243.2 | 301.3 | 10.7 | 47.5 | 22.7 | 76.0 | | |
| | Avg. | 243.4 | 302.2 | 10.8 | 46.9 | 21.9 | 77.4 | 54.7 | 9 |
| Ht. 3 | 1 | 244.2 | 303.3 | 10.5 | 46.5 | 19.8 | 66.6 | | |
| | 2 | 244.0 | 302.9 | 10.9 | 46.7 | 20.8 | 73.7 | | |
| | Avg. | 244.1 | 303.1 | 10.7 | 46.6 | 20.3 | 70.2 | 54.9 | 9 |
| Ht. 4 | 1 | 243.5 | 303.2 | 11.2 | 50.3 | 21.5 | 69.3 | | |
| | 2 | 240.7 | 299.7 | 11.4 | 51.0 | 21.4 | 71.9 | | |
| | Avg. | 242.1 | 301.5 | 11.3 | 50.6 | 21.5 | 70.6 | 54.9 | 9 |
| Ht. A | 1 | 236.7 | 297.9 | 10.4 | 44.8 | 16.7 | 76.0 | | |
| | 2 | 239.0 | 300.6 | 12.5 | 47.6 | 15.9 | 77.2 | | |
| | Avg. | 237.8 | 299.3 | 11.5 | 46.2 | 16.3 | 76.6 | 55.0 | 5 |
| Ht. B | 1 | 242.5 | 302.4 | 10.4 | 44.2 | 17.2 | 55.3 | | |
| | 2 | 242.6 | 302.9 | 11.5 | 48.2 | 17.9 | 52.2 | | |
| | Avg. | 242.5 | 302.6 | 11.0 | 46.2 | 17.6 | 53.8 | 54.9 | 6 |

Example 2

Set forth in Table 3 are the weight percent compositions of four additional 35-lb. heats that were vacuum induction melted and cast in the same manner as the heats described in Example 1 above.

TABLE 3

| | Heat 5 | Heat 6 | Heat 7 | Heat 8 | Heat A |
|---|---|---|---|---|---|
| C | 0.41 | 0.41 | 0.42 | 0.41 | 0.36 |
| Mn | 1.18 | 1.18 | 1.18 | 1.18 | 1.18 |
| Si | 2.08 | 2.08 | 1.98 | 2.06 | 2.03 |
| P | <0.005 | <0.005 | <0.005 | <0.005 | <0.005 |
| S | <0.0005 | <0.0005 | <0.0005 | <0.0005 | <0.0005 |
| Cr | 1.74 | 1.73 | 1.74 | 1.74 | 1.75 |
| Ni | 4.68 | 4.72 | 4.67 | 4.70 | 3.23 |
| Mo | 0.77 | 0.77 | 0.77 | 0.77 | 0.78 |
| Cu | 0.79 | 0.79 | 0.79 | 0.79 | 0.79 |

TABLE 3-continued

| | Heat 5 | Heat 6 | Heat 7 | Heat 8 | Heat A |
|---|---|---|---|---|---|
| V | 0.19 | 0.19 | 0.19 | 0.19 | 0.19 |
| Y | 0.0030 | 0.0080 | 0.0130 | 0.0200 | — |
| Ca | 0.0012 | 0.0006 | 0.0008 | 0.0006 | 0.0016 |

The balance of each heat was iron and usual impurities. Heats 5 to 8 are embodiments of the alloy according to the present invention. Heat A is the comparative heat. Heats 5-6 differ from Heat A with respect to the retained amounts of yttrium.

Heats 5-8 and A were processed and tested similarly to the heats in Example 1. Set forth in Tables 4A and 4B are the results of room temperature mechanical testing of the duplicate samples from each heat including the 0.2% offset yield strength (Y.S.) and the ultimate tensile strength (U.T.S.), the percent elongation (% El.), the percent reduction in area (% R.A.), the Charpy V-notch impact energy (CVN) in foot-pounds (ft.-lbs.), the rising step load fracture toughness ($K_{Ic}$) in ksi√in, the Rockwell C-scale hardness (HRC). The tested samples were also metallographically examined for grain size and the ASTM grain size number for each heat is also shown in Table 3. Table 4A contains the results for the samples given Heat treatment A and Table 4B contains the results for the samples given Heat treatment B.

TABLE 4A

| Heat ID | Sample | Y.S. | U.T.S. | % El. | % R.A. | CVN | $K_{Ic}$ | HRC | Grain Size |
|---|---|---|---|---|---|---|---|---|---|
| Ht. 5 | 1 | 238.0 | 297.3 | 12.2 | 46.7 | 18.4 | 78.8 | | |
| | 2 | 238.1 | 296.1 | 10.6 | 37.5 | 18.3 | 80.0 | | |
| | Avg. | 238.0 | 296.7 | 11.4 | 42.1 | 18.4 | 79.4 | 54.1 | 8 |
| Ht. 6 | 1 | 235.4 | 293.0 | 11.2 | 47.3 | 18.9 | 77.3 | | |
| | 2 | —[1] | —[1] | —[1] | —[1] | 16.3 | 80.7 | | |
| | Avg. | 235.4 | 293.0 | 11.2 | 47.3 | 17.6 | 79.0 | 53.4 | 7 |
| Ht. 7 | 1 | 239.5 | 298.2 | 11.6 | 47.0 | 17.5 | 75.2 | | |
| | 2 | 240.9 | 297.9 | 10.5 | 43.9 | 16.1 | 75.4 | | |
| | Avg. | 240.2 | 298.0 | 11.1 | 45.4 | 16.8 | 75.3 | 54.2 | 7 |
| Ht. 8 | 1 | 230.5 | 291.4 | 10.3 | 43.0 | 16.6 | 73.6 | | |
| | 2 | 233.9 | 294.2 | 11.2 | 45.4 | 17.4 | 75.8 | | |
| | Avg. | 232.2 | 292.8 | 10.8 | 44.2 | 17.0 | 74.7 | 53.5 | 7 |
| Ht. A | 1 | 243.5 | 301.4 | 10.3 | 44.7 | 14.0 | 70.8 | | |
| | 2 | 244.6 | 301.5 | 10.2 | 40.6 | 15.5 | 70.2 | | |
| | Avg. | 244.0 | 301.4 | 10.3 | 42.6 | 14.8 | 70.5 | 55.7 | 7 |

[1]Tensile test results not valid because of defective specimen.

TABLE 4B

| Heat ID | Sample | Y.S. | U.T.S. | % El. | % R.A. | CVN | $K_{Ic}$ | HRC | Grain Size |
|---|---|---|---|---|---|---|---|---|---|
| Ht. 5 | 1 | 236.7 | 297.8 | 10.4 | 39.2 | 17.4 | — | | |
| | 2 | 237.4 | 297.2 | 11.0 | 47.2 | 18.8 | 84.0 | | |
| | Avg. | 237.1 | 297.5 | 10.7 | 43.2 | 18.1 | 84.0 | 54.2 | 7 |
| Ht. 6 | 1 | 233.3 | 292.9 | 12.3 | 50.2 | 16.7 | 80.9 | | |
| | 2 | 234.4 | 292.3 | 10.9 | 46.3 | 16.7 | 80.5 | | |
| | Avg. | 233.8 | 292.6 | 11.6 | 48.3 | 16.7 | 80.7 | 53.6 | 7 |
| Ht. 7 | 1 | 239.1 | 298.7 | 11.7 | 42.6 | 18.1 | 75.9 | | |
| | 2 | 240.6 | 299.5 | 10.9 | 47.4 | 18.7 | 76.4 | | |
| | Avg. | 239.9 | 299.1 | 11.3 | 45.0 | 18.4 | 76.2 | 54.7 | 7 |
| Ht. 8 | 1 | 236.7 | 296.1 | 11.7 | 50.1 | 17.0 | 78.5 | | |
| | 2 | 236.7 | 296.3 | 11.8 | 47.0 | 16.3 | 77.2 | | |
| | Avg. | 236.7 | 296.2 | 11.8 | 48.6 | 16.7 | 77.9 | 54.2 | 6 |
| Ht. A | 1 | 236.7 | 297.9 | 10.4 | 44.8 | 16.7 | 76.0 | | |
| | 2 | 239.0 | 300.6 | 12.5 | 47.6 | 15.9 | 77.2 | | |
| | Avg. | 237.8 | 299.3 | 11.5 | 46.2 | 16.3 | 76.6 | 55.0 | 5 |

Example 3

In order to demonstrate the novel combination of strength and toughness provided by the alloy according to this invention, six additional 35-lb. heats having the weight percent compositions set forth in Table 5 below were vacuum induction melted and cast into 4-inch square ingots. The heats were processed similar to Heats 1-4, A, and B during melting.

TABLE 5

| | Heat 9 | Heat 10 | Heat 11 | Heat 12 | Heat 13 | Heat C |
|---|---|---|---|---|---|---|
| C | 0.41 | 0.41 | 0.41 | 0.42 | 0.41 | 0.40 |
| Mn | 1.17 | 1.18 | 1.18 | 1.18 | 1.2 | 1.18 |
| Si | 2.07 | 2.08 | 2.04 | 2.11 | 2.05 | 2.04 |
| P | <0.005 | <0.005 | <0.005 | <0.005 | <0.005 | <0.005 |
| S | <0.0005 | <0.0005 | <0.0005 | <0.0005 | <0.0005 | <0.0005 |
| Cr | 1.75 | 1.74 | 1.75 | 1.74 | 1.74 | 1.74 |
| Ni | 4.68 | 4.70 | 4.69 | 4.71 | 4.70 | 4.71 |
| Mo | 0.76 | 0.77 | 0.77 | 0.77 | 0.76 | 0.77 |
| Cu | 0.79 | 0.79 | 0.79 | 0.79 | 0.81 | 0.79 |
| V | 0.19 | 0.19 | 0.19 | 0.19 | 0.17 | 0.19 |

TABLE 5-continued

| | Heat 9 | Heat 10 | Heat 11 | Heat 12 | Heat 13 | Heat C |
|---|---|---|---|---|---|---|
| Mg | 0.0001 | 0.0007 | 0.0020 | 0.0050 | 0.0080 | — |
| Ca | 0.0011 | 0.0012 | 0.0014 | 0.0009 | 0.0008 | 0.0018 |

The balance of each heat was iron and usual impurities. Heats 9 to 13 are embodiments of the alloy according to the present invention. Heat C is a comparative heat. Heats 9-13 differ from Heat C with respect to the retained amounts magnesium.

Heats 5-8 and C were processed and tested similarly to the heats in Example 1. Set forth in Tables 6A and 6B are the results of room temperature mechanical testing of the duplicate samples from each heat including the 0.2% offset yield strength (Y.S.) and the ultimate tensile strength (U.T.S.), the percent elongation (% El.), the percent reduction in area (% R.A.), the Charpy V-notch impact energy (CVN) in foot-pounds (ft.-lbs.), the rising step load fracture toughness ($K_{Ic}$) in ksi√in, the Rockwell C-scale hardness (HRC). The tested samples were also metallographically examined for grain size and the ASTM grain size number for each heat is also shown in Tables 6A and 6B. Table 6A contains the results for the samples given Heat treatment A and Table 6B contains the results for the samples given Heat treatment B.

TABLE 6A

| Heat ID | Sample | Y.S. | U.T.S. | % El. | % R.A. | CVN | $K_{Ic}$ | HRC | Grain Size |
|---|---|---|---|---|---|---|---|---|---|
| Ht. 9 | 1 | 256.4 | 319.1 | 10.8 | 45.4 | 19.7 | 51.8 | | |
| | 2 | 259.9 | 320.4 | 9.4 | 45.4 | 16.7 | 55.7 | | |
| | Avg. | 258.1 | 319.7 | 10.1 | 45.4 | 18.2 | 53.8 | 56.1 | 9 |
| Ht. 10 | 1 | 256.4 | 317.8 | 9.8 | 37.0 | 20.1 | 52.3 | | |
| | 2 | 257.0 | 316.0 | 10.0 | 41.8 | 19.2 | 54.4 | | |
| | Avg. | 256.7 | 316.9 | 9.9 | 39.4 | 19.7 | 53.4 | 56.0 | 9 |
| Ht. 11 | 1 | 250.3 | 313.6 | 10.3 | 42.5 | 20.0 | 53.8 | | |
| | 2 | 256.2 | 315.5 | 10.3 | 46.1 | 20.5 | 52.4 | | |
| | Avg. | 253.2 | 314.5 | 10.3 | 44.3 | 20.3 | 53.1 | 55.7 | 9 |
| Ht. 12 | 1 | 256.4 | 319.0 | 10.5 | 44.4 | 20.1 | 49.2 | | |
| | 2 | 252.6 | 315.8 | 10.2 | 41.4 | 19.4 | 51.6 | | |
| | Avg. | 254.5 | 317.4 | 10.4 | 42.9 | 19.8 | 50.4 | 55.7 | 9 |
| Ht. 13 | 1 | 253.6 | 315.3 | 10.8 | 47.6 | 17.3 | 47.0 | | |
| | 2 | 255.9 | 316.9 | 9.5 | 40.4 | 15.1 | 46.6 | | |
| | Avg. | 254.7 | 316.1 | 10.2 | 44.0 | 16.2 | 46.8 | 55.7 | 9.5 |
| Ht. C | 1 | 253.7 | 314.6 | 10.3 | 42.6 | 12.9 | 52.3 | | |
| | 2 | 256.5 | 316.9 | 10.2 | 44.4 | 13.3 | 51.6 | | |
| | Avg. | 255.1 | 315.7 | 10.3 | 43.5 | 13.1 | 52.0 | 56.8 | 8 |

TABLE 6B

| Heat ID | Sample | Y.S. | U.T.S. | % El. | % R.A. | CVN | $K_{Ic}$ | HRC | Grain Size |
|---|---|---|---|---|---|---|---|---|---|
| Ht. 9 | 1 | 250.1 | 311.0 | 10.3 | 44.2 | 17.3 | 59.1 | | |
| | 2 | 248.5 | 313.6 | 11.1 | 45.4 | 19.4 | 54.3 | | |
| | Avg. | 249.3 | 312.3 | 10.7 | 44.8 | 18.4 | 56.7 | 56.0 | 9 |
| Ht. 10 | 1 | 251.8 | 315.0 | 11.4 | 47.8 | 21.8 | 60.8 | | |
| | 2 | 251.6 | 314.2 | 10.7 | 47.2 | 19.7 | 56.8 | | |
| | Avg. | 251.7 | 314.6 | 11.1 | 47.5 | 20.8 | 58.8 | 56.2 | 8 |
| Ht. 11 | 1 | 251.3 | 314.6 | 10.9 | 47.2 | 20.8 | 60.5 | | |
| | 2 | —[1] | —[1] | —[1] | —[1] | 21.6 | 58.5 | | |
| | Avg. | 251.3 | 314.6 | 10.9 | 47.2 | 21.2 | 59.5 | 55.7 | 8 |
| Ht. 12 | 1 | 252.5 | 317.3 | 11.5 | 47.0 | 16.9 | 57.4 | | |
| | 2 | 253.5 | 317.0 | 9.6 | 42.6 | 21.1 | 59.0 | | |
| | Avg. | 253.0 | 317.2 | 10.5 | 44.8 | 19.0 | 58.2 | 56.1 | 9 |
| Ht. 13 | 1 | 252.3 | 315.0 | 12.0 | 50.2 | 19.4 | 50.0 | | |
| | 2 | 249.7 | 314.4 | 11.3 | 47.7 | 19.3 | 51.5 | | |
| | Avg. | 251.0 | 314.7 | 11.7 | 48.9 | 19.4 | 50.8 | 56.4 | 9 |
| Ht. C | 1 | 250.8 | 313.6 | 9.5 | 37.8 | 14.2 | 58.4 | | |
| | 2 | 252.1 | 314.7 | 11.3 | 47.3 | 14.7 | 56.6 | | |
| | Avg. | 251.5 | 314.2 | 10.4 | 42.6 | 14.5 | 57.5 | 55.8 | 6 |

[1]Tensile testing performed on only one specimen for this heat and heat treatment.

Example 4

Set forth in Table 7 are the weight percent compositions of four additional 35-lb. heats that were vacuum induction melted and cast in the same manner as the heats described in Example 1 above.

TABLE 7

| | Heat 14 | Heat 15 | Heat 16 | Heat 17 | Heat C |
|---|---|---|---|---|---|
| C | 0.41 | 0.41 | 0.42 | 0.40 | 0.40 |
| Mn | 1.18 | 1.18 | 1.18 | 1.18 | 1.18 |
| Si | 2.08 | 2.08 | 1.98 | 2.06 | 2.04 |
| P | <0.005 | <0.005 | <0.005 | <0.005 | <0.005 |
| S | <0.0005 | <0.0005 | <0.0005 | <0.0005 | <0.0005 |
| Cr | 1.74 | 1.73 | 1.74 | 1.74 | 1.74 |
| Ni | 4.68 | 4.72 | 4.67 | 4.70 | 4.71 |
| Mo | 0.77 | 0.77 | 0.77 | 0.77 | 0.77 |
| Cu | 0.79 | 0.79 | 0.79 | 0.79 | 0.79 |
| V | 0.19 | 0.19 | 0.19 | 0.19 | 0.19 |

TABLE 7-continued

| | Heat 14 | Heat 15 | Heat 16 | Heat 17 | Heat C |
|---|---|---|---|---|---|
| Y | 0.0030 | 0.0080 | 0.0130 | 0.0200 | — |
| Ca | 0.0012 | 0.0006 | 0.0008 | 0.0006 | 0.0018 |

The balance of each heat was iron and usual impurities. Heats 14 to 17 are embodiments of the alloy according to the present invention. Heat C is the comparative heat. Heats 14-17 differ from Heat C with respect to the retained amounts of yttrium.

Heats 14-17 and C were processed and tested similarly to the heats in Example 1. Set forth in Tables 8A and 8B are the results of room temperature mechanical testing of the duplicate samples from each heat including the 0.2% offset yield strength (Y.S.) and the ultimate tensile strength (U.T.S.), the percent elongation (% El.), the percent reduction in area (% R.A.), the Charpy V-notch impact energy (CVN) in foot-pounds (ft.-lbs.), the rising step load fracture toughness ($K_{Ic}$) in ksi√in, the Rockwell C-scale hardness (HRC). The tested samples were also metallographically examined for grain size and the ASTM grain size number for each heat is also shown in Tables 8A and 8B. Table 8A contains the results for the samples given Heat treatment A and Table 8B contains the results for the samples given Heat treatment B.

TABLE 8A

| Heat ID | Sample | Y.S. | U.T.S. | % El. | % R.A. | CVN | $K_{Ic}$ | HRC | Grain Size |
|---|---|---|---|---|---|---|---|---|---|
| Ht. 14 | 1 | 254.4 | 315.0 | 9.7 | 40.4 | 18.3 | 65.2 | | |
| | 2 | 255.4 | 314.3 | 10.0 | 43.7 | 16.5 | 58.2 | | |
| | Avg. | 254.9 | 314.6 | 9.9 | 42.0 | 17.4 | 61.7 | 56.1 | 9 |
| Ht. 15 | 1 | 255.5 | 314.9 | 10.6 | 45.6 | 15.2 | 58.1 | | |
| | 2 | 253.6 | 313.3 | 9.8 | 43.2 | 16.4 | 55.1 | | |
| | Avg. | 254.6 | 314.1 | 10.2 | 44.4 | 15.8 | 56.6 | 55.9 | 10 |
| Ht. 16 | 1 | 258.9 | 318.2 | 10.8 | 42.7 | 14.1 | 56.8 | | |
| | 2 | 256.2 | 315.9 | 10.8 | 42.7 | 13.9 | 53.2 | | |
| | Avg. | 257.6 | 317.1 | 10.8 | 42.7 | 14.0 | 55.0 | 56.2 | 10 |
| Ht. 17 | 1 | 253.7 | 312.0 | 10.0 | 42.9 | 19.7 | 63.4 | | |
| | 2 | 255.1 | 313.2 | 10.3 | 48.5 | 19.9 | 56.6 | | |
| | Avg. | 254.4 | 312.6 | 10.2 | 45.7 | 19.8 | 60.0 | 55.7 | 9 |
| Ht. C | 1 | 253.7 | 314.6 | 10.3 | 42.6 | 12.9 | 52.3 | | |
| | 2 | 256.5 | 316.9 | 10.2 | 44.4 | 13.3 | 51.6 | | |
| | Avg. | 255.1 | 315.7 | 10.3 | 43.5 | 13.1 | 52.0 | 55.8 | 8 |

TABLE 8B

| Heat ID | Sample | Y.S. | U.T.S. | % El. | % R.A. | CVN | $K_{Ic}$ | HRC | Grain Size |
|---|---|---|---|---|---|---|---|---|---|
| Ht. 14 | 1 | 252.8 | 314.7 | 11.6 | 47.8 | 19.8 | 58.5 | | |
| | 2 | 252.8 | 314.3 | 10.3 | 45.1 | 18.1 | 58.4 | | |
| | Avg. | 252.8 | 314.5 | 10.9 | 46.4 | 19.0 | 58.5 | 55.3 | 7 |
| Ht. 15 | 1 | 252.9 | 314.7 | 10.3 | 43.0 | 21.5 | 54.7 | | |
| | 2 | 254.4 | 314.7 | 10.9 | 43.8 | 21.4 | 59.9 | | |
| | Avg. | 253.6 | 314.7 | 10.6 | 43.4 | 21.5 | 57.3 | 53.7 | 7 |
| Ht. 16 | 1 | 254.7 | 316.8 | 10.6 | 45.1 | 14.4 | 55.1 | | |
| | 2 | 255.6 | 316.2 | 10.6 | 48.0 | 17.7 | 55.3 | | |
| | Avg. | 255.1 | 316.5 | 10.6 | 46.5 | 16.1 | 55.2 | 55.9 | 7 |
| Ht. 17 | 1 | 253.7 | 314.1 | 10.8 | 47.4 | 20.5 | 61.4 | | |
| | 2 | 253.3 | 313.7 | 10.9 | 46.2 | 19.7 | 62.6 | | |
| | Avg. | 253.5 | 313.9 | 10.9 | 46.8 | 20.1 | 62.0 | 55.9 | 9 |
| Ht. C | 1 | 250.8 | 313.6 | 9.5 | 37.8 | 14.2 | 58.4 | | |
| | 2 | 252.1 | 314.7 | 11.3 | 47.3 | 14.7 | 56.6 | | |
| | Avg. | 251.5 | 314.2 | 10.4 | 42.6 | 14.5 | 57.5 | 55.8 | 6 |

The data presented in Examples 1 to 4 show that the heats of the alloy according to the present invention provide significantly better combinations of strength and toughness than the comparative heats representing the known alloys.

The terms and expressions which are employed herein are used as terms of description and not of limitation. There is no intention in the use of such terms and expressions of excluding any equivalents of the features shown and described or portions thereof. It is recognized that various modifications are possible within the invention described and claimed herein.

The invention claimed is:

1. A high strength, high toughness steel alloy having good temper resistance, said alloy comprising, in weight percent, about:

| | |
|---|---|
| C | 0.30-0.45 |
| Mn | 0.8-1.75 |
| Si | 1.5-2.7 |
| Cr | 1.5-2.0 |
| Ni | 3.0-4.5 |
| Mo + ½ W | 0.25-1.3 |
| Cu | 0.35-1.2 |
| Co | 0.01 max. |
| V + (5/9) × Nb | 0.1-0.4 |
| Ti | 0.01 max. |
| Al | 0.015 max. |
| Ca | 0.005 max. |

a grain-refining element selected from the group consisting of 0.0001-0.008% Mg, 0.001-0.025% Y, and a combination thereof; and the balance being iron and usual impurities wherein phosphorus is restricted to about 0.01% max. and sulfur is restricted to not more than about 0.001% max., and wherein $$14.5 \leq (\%\ Si + \%\ Cu)/(\%\ V + (5/9) \times \%\ Nb) \leq 34.$$

2. The alloy as set forth in claim 1 wherein the alloy contains at least about 0.002% yttrium.

3. The alloy as set forth in claim 2 wherein the alloy contains not more than about 0.020% yttrium.

4. The alloy as set forth in claim 1 wherein the alloy contains not more than about 0.006% magnesium.

5. The alloy as set forth in claim 1 wherein the alloy contains not more than about 0.002% calcium.

6. The alloy as set forth in claim 1 wherein the alloy contains at least about 0.35% carbon.

7. The alloy as set forth in claim 1 wherein the alloy contains not more than about 1.8% chromium.

8. The alloy as set forth in claim 1 wherein Mo+½ W is at least about 0.4%.

9. The alloy as set forth in claim 8 wherein Mo+½ W is not more than about 1.1%.

10. A high strength, high toughness steel alloy having good temper resistance, said alloy comprising, in weight percent, about:

| | |
|---|---|
| C | 0.33-0.45 |
| Mn | 0.8-1.3 |
| Si | 1.5-2.70 |
| Cr | 1.5-1.8 |
| Ni | 3.0-4.5 |
| Mo + ½ W | 0.4-1.3 |
| Cu | 0.35-1.2 |
| Co | 0.01 max. |
| V + (5/9) × Nb | 0.10-0.40 |
| Ti | 0.01 max. |
| Al | 0.015 max. |
| Ca | 0.001 max. |

a grain-refining element selected from the group consisting of 0.0001-0.006% Mg, 0.002-0.020% Y, and a combination thereof; and the balance being iron and usual impurities wherein phosphorus is restricted to about 0.01% max. and sulfur is restricted to not more than about 0.001% max., and wherein $$14.5 \leq (\%\ Si + \%\ Cu)/(\%\ V + (5/9) \times \%\ Nb) \leq 34.$$

11. A hardened and tempered article made from a high strength, high toughness steel alloy as set forth in claim 1 wherein the article is tempered at a temperature of about 500° F. to 600° F.

12. The hardened and tempered article as set forth in claim 11 which provides a room temperature ultimate tensile strength of at least about 295 ksi and a Charpy V-notch impact toughness of at least about 15 ft-lbs.

* * * * *